US006915610B2

(12) United States Patent
Stark, III et al.

(10) Patent No.: US 6,915,610 B2
(45) Date of Patent: Jul. 12, 2005

(54) MULTI-PURPOSE ARENA

(75) Inventors: Charles H. Stark, III, Toledo, OH (US); Keith E. Riley, Toledo, OH (US)

(73) Assignee: SSOE, Inc., Toledo, OH (US)

( * ) Notice: Subject to any disclaimer, the term of this patent is extended or adjusted under 35 U.S.C. 154(b) by 106 days.

(21) Appl. No.: 10/222,338

(22) Filed: Aug. 16, 2002

(65) Prior Publication Data

US 2003/0037490 A1 Feb. 27, 2003

Related U.S. Application Data

(60) Provisional application No. 60/314,212, filed on Aug. 22, 2001.

(51) Int. Cl.[7] ..... E04H 3/10

(52) U.S. Cl. ..... 52/6; 52/7; 52/8; 52/144; 52/145

(58) Field of Search ..... 52/6, 7, 8, 9, 741.1, 52/144, 145; 472/85, 92, 93

(56) References Cited

U.S. PATENT DOCUMENTS 5,829,201 A * 11/1998 Schelter et al. ..... 52/9
5,850,712 A * 12/1998 Errato ..... 52/8
5,921,032 A * 7/1999 Labinski ..... 52/9
5,927,022 A * 7/1999 Hirakawa et al. ..... 52/6
6,164,018 A * 12/2000 Runge et al. ..... 52/8
6,244,378 B1 * 6/2001 McGrath ..... 181/292
6,407,798 B2 * 6/2002 Graves et al. ..... 352/69

OTHER PUBLICATIONS

AVL, System, Inc, 2001.*

* cited by examiner

*Primary Examiner*—Carl D. Friedman
*Assistant Examiner*—Chi Q. Nguyen
(74) *Attorney, Agent, or Firm*—Emch, Schaffer, Schaub & Porcello, Co., L.P.A.

(57) ABSTRACT

The present invention is directed to a multi-purpose arena that can be used for sport and non-sport type of events. The size of the arena can be varied to suit the particular type of entertainment present in the arena. The acoustics can also be varied or tuned to maximize the performance in the arena. The seating in the arena is disposed to provide excellent viewing of the entertainment being performed in the arena. And, the arena can accommodate the staging requirements for almost any use that is developed for the arena.

24 Claims, 14 Drawing Sheets

MULTI-PURPOSE ARENA

CROSS-REFERENCE TO RELATED APPLICATION

This application is based upon and claims the benefit of U.S. Provisional Application, Ser. No. 60/314,212, filed on Aug. 22, 2001.

BACKGROUND OF THE INVENTION

The present invention is generally directed to a multi-purpose arena that can be used for sports and other entertainment. Most arenas are designed with a sport-type activity as the main use for the arena. In fact, most arenas are used for sport-type activities for only a small portion of the days that the facility is in use. Most of the time, the arena is used for public entertainment uses such as concerts, speakers, theatre, productions, graduations, assemblies and other non-sport uses. Unfortunately, by designing an arena as a sports facility, the arena has characteristics that make it less than ideal for public entertainment uses.

The major shortcomings of a sports arena when the facility is used for non-sports type, public entertainment uses are poor acoustics, a sound system than cannot overcome the poor acoustics, poor sight lines and seating angles, large distances between the audience and the performers, limited facilities for the comfort and convenience of the performers, lack of staging options, seats that lack acceptable comfort for non-sports activity and an inability to tailor the size of the facility to match the space requirements for the particular use of the arena. The above difficulties are significant as in most arenas, sport type activities account for less that one half of the total use time for the arena.

The multi-purpose arena of the present invention provides an arena that is designed to accommodate the multitude of uses that today's arenas are required to handle. The size or seating capacity of the arena can be varied to suit the particular use of the arena. The seats in the arena are oriented to the area where the entertainment is to take place to avoid seating areas that are not usable for many entertainment applications. The arena is designed to have an interior shape that is non-symmetrical with irregular dimensions. Such a design for the interior of the arena reduces the ability of sound waves to be reflected from surfaces in the arena in a manner where the sound waves are directed back to the performers at substantially their initial intensity. This shape for the interior of the arena avoids concave surfaces in the interior of the arena that can focus sound into acoustic "hot spots" that produce undesirable sound characteristics. The shape of the interior of the arena is designed to significantly reduce standing wave and rhythmic wave sound patterns that produce undesirable sound characteristics in many arenas. A standing wave is an acoustical phenomenon where the amplification and clarity of a sound wave is increased or reduced in localized areas. A standing wave produces hot spots (increased) or dead spots (reduced) in an arena. Such hot and dead spots are objectionable to patrons or performers that are in a location where such phenomenon occur. A rhythmic wave is best described as the objectionable background buzz that is heard in a room or in an arena when the sound in the room is not properly controlled or balanced. The seats are comfortable and with good sight lines to the entertainment area. The acoustics of the arena can be varied or tuned to enhance the particular event that is being presented in the arena. The managing of sound or acoustical characteristics is an important aspect of the invention. Sound and acoustics are complex technical concepts that are difficult to explain. To assist with these concepts, the text "Handbook of Acoustical Measurement and Noise Control" by Cyril M. Harris, published by McGraw-Hill, Inc. is hereby incorporated by reference in this disclosure.

SUMMARY OF THE INVENTION

The present invention is directed to a multi-purpose arena that can be used for sport and non-sport type of events. The size of the arena can be varied to suit the particular type of entertainment presented in the arena without sacrificing sight lines and while improving viewing distances. The acoustics can also be varied or tuned to maximize the performance in the arena. The seating in the arena is disposed to provide excellent viewing of the entertainment being performed in the arena. And, the arena can accommodate the staging requirements for almost any use that is developed for the arena.

Other objects and advantages of the present invention will become apparent to those skilled in the art upon a review of the following detailed description of the preferred embodiments and the accompanying drawings.

DETAILED DESCRIPTION OF THE PREFERRED EMBODIMENTS

This invention is directed to a multi-purpose arena. More particularly, the multi-purpose arena is useful for entertainment activity while still being useful for sporting events. The details of the invention will be more readily understood by referring to the attached drawing in combination with the following description of the invention.

Figure 1:
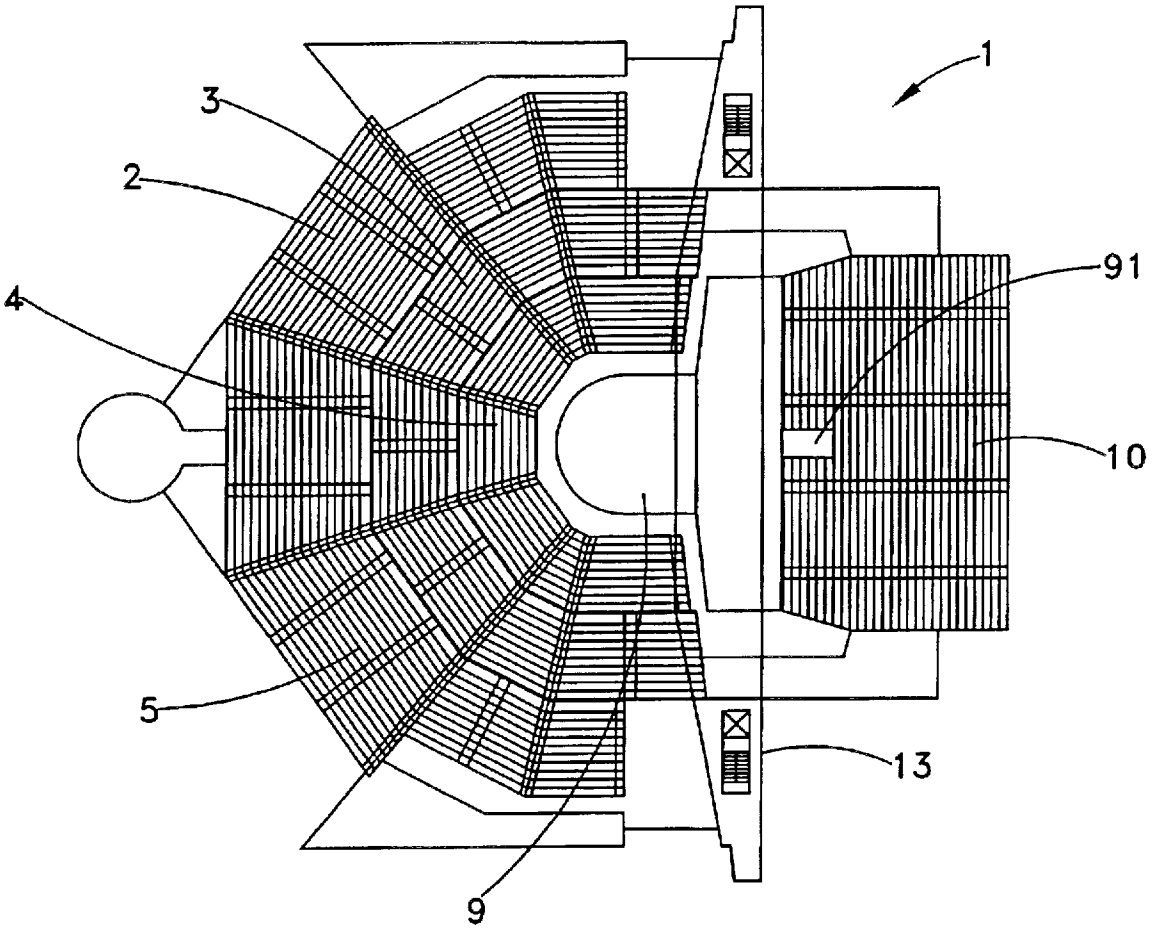
FIG. 1 is a plan view of the interior of the multi-purpose arena of the present invention.
Figure 2:
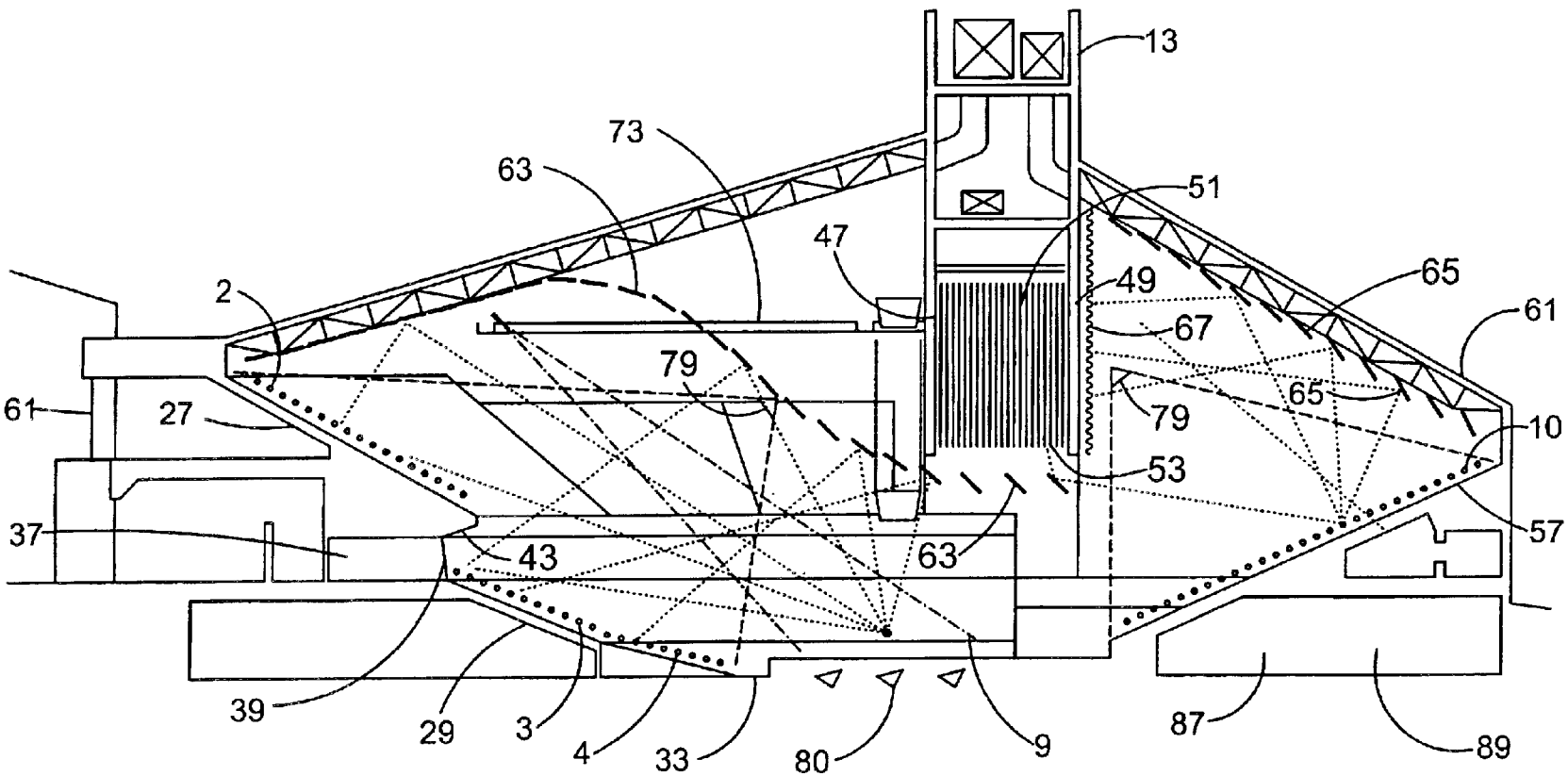
FIG. 2 is a cross sectional view of the multi-purpose arena.
Figure 12:
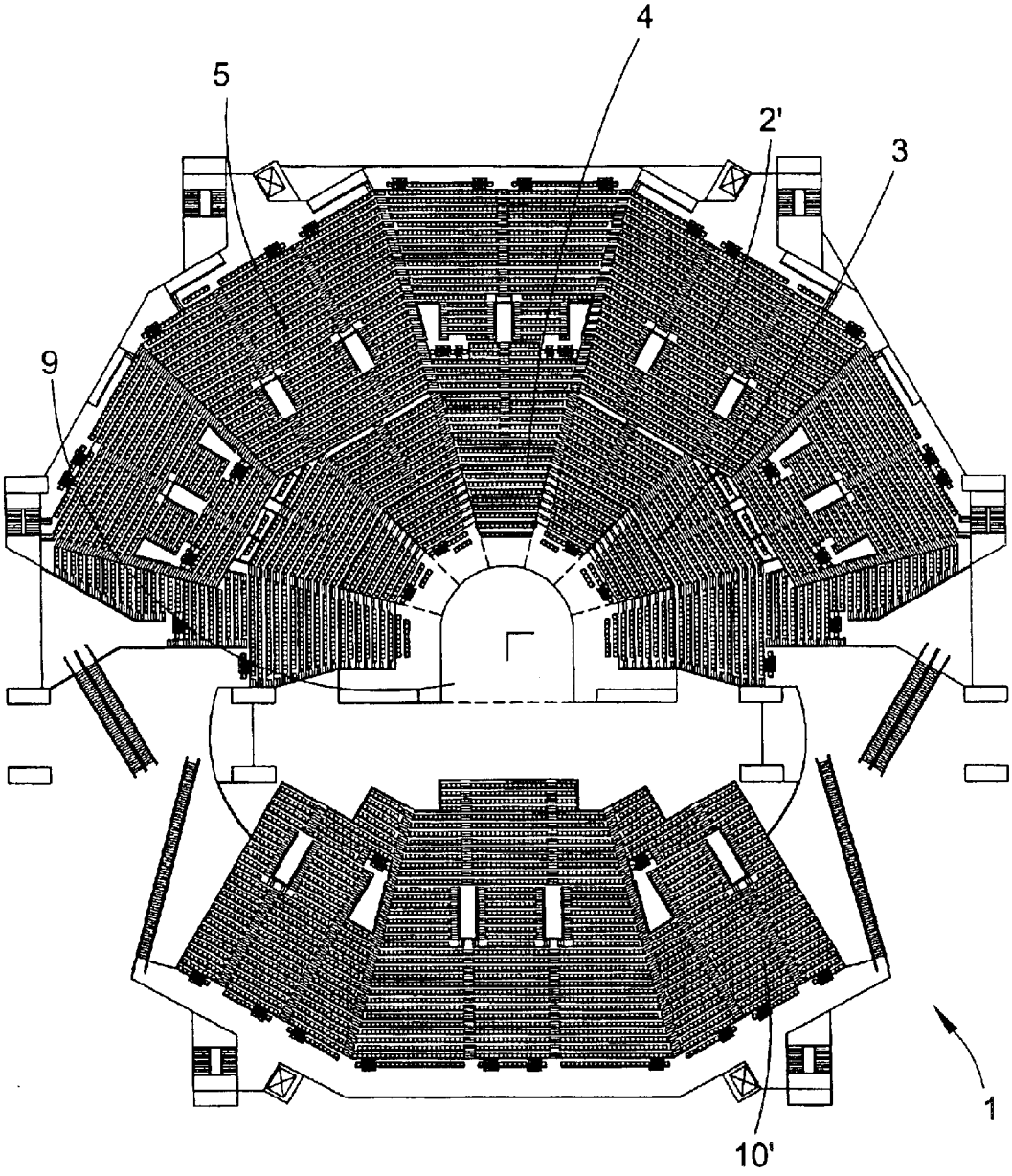
FIG. 12 is a plan view of the multi-purpose arena.
Figure 13:
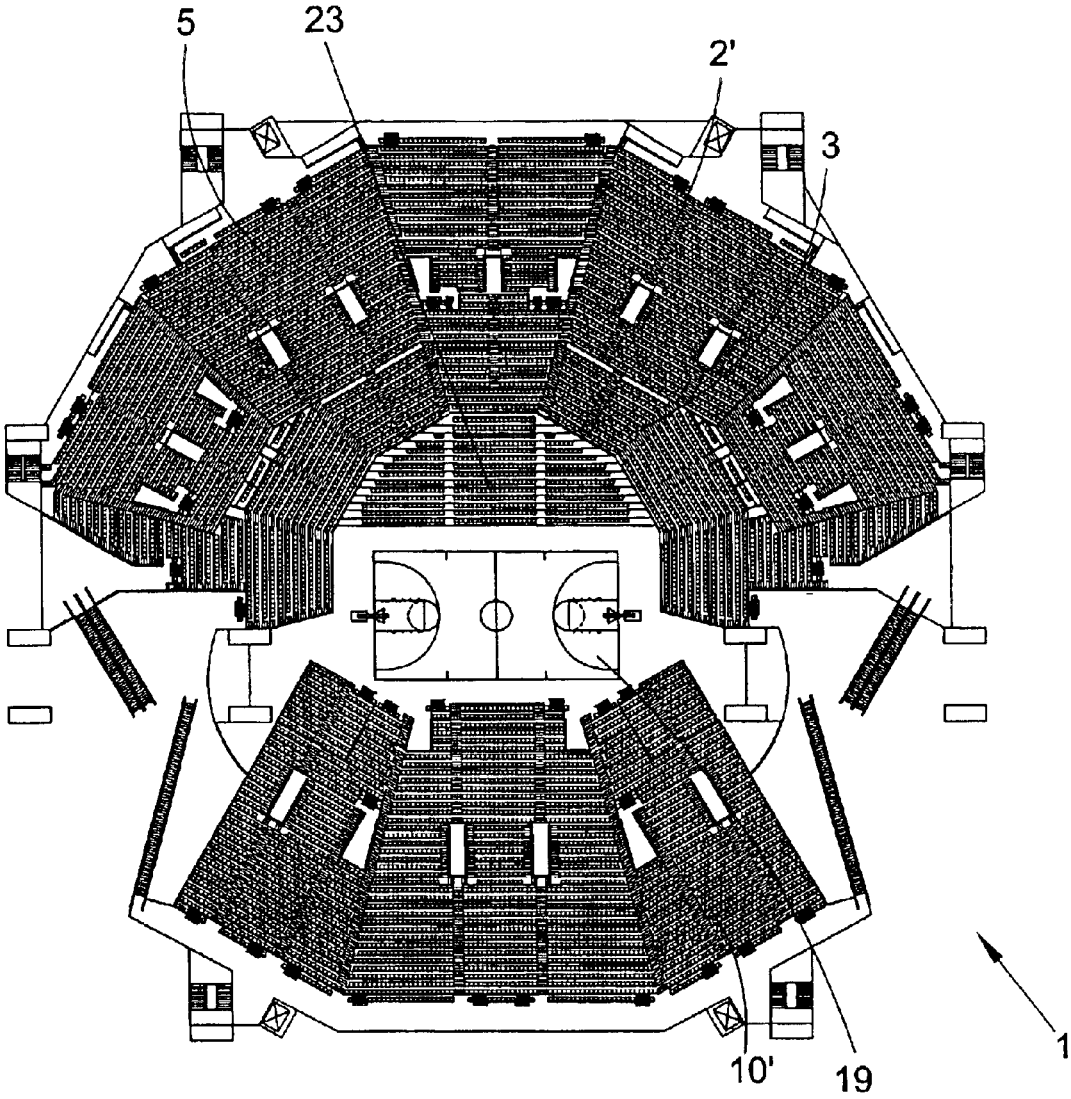
FIG. 13 is a plan view of the multi-purpose arena.

FIGS. 1 and 2 show the multi-purpose arena 1 configuration when used for concert/convocation uses. In this configuration, there is a stage 9 in the center of the arena and a semi-circular grouping of seats 5 positioned outwardly from the stage. The semi-circular grouping of seats 5 is comprised of upper seating level 2, a mid-seating level 3 and a lower seating level 4. Positioned behind the stage 9 is another bank of seats 10. The upper level seating 2, mid-level seating 3, lower level seating 4 and bank of seating 10 are all oriented toward the performance and on tiers that define an incline to provide good viewing for the stage 9. As shown in FIGS. 12 and 13, the upper level seating 2' can be in an elliptical orientation to improve the lines of sight for the patrons in these seats. If a graduation or similar type of event is being held, the graduates can be seated in the bank of seating 10 behind the stage 9 and facing the people in the audience in the semi-circular group of seats 5. The graduates can also have access to the stage 9 if desired. An elevated arch 13 is positioned in the arena 1 so that the arch extends between the bank of seats 10 behind the stage 9 and the upper, mid and lower level seats that are positioned in a semi-circular fashion around the front of the stage 9. The seats are arranged to keep the audience as close as possible to the performance and to provide good sight lines from the audience to the performing area. The elevated arch is spaced a considerable distance from the floor of the stage 9 and can be used to accommodate rigging lines, scenery, lighting and other accessories used during theatrical or musical productions. The arch 13 is usually positioned from about 20 to about 60 feet above the stage 9 of the arena. In most applications, it is preferred that the arch 13 be positioned from about 35 to about 45 feet above the stage 9.

The elevated arch 13 has a wall 47 that is positioned to face the semi-circular seating 5 in the arena 1 and an opposed wall 49. The opposed wall 49 of the elevated arch 13 faces the bank of seats 10 located behind the stage 9. The elevated arch 13 forms an open cavity 53 between the wall 47 and the wall 49 that form the elevated arch. Rigging lines, scenery, lighting and other equipment 51 used for theatrical and sporting events can be located in the open cavity of the elevated arch 13.

As shown in FIGS. 1, 3, 4 and 5, the elevated arch 13 spans the stage 9 and the basketball court or sports floor 19. The arch 13 is accessed by stairs 71 located on either end of the elevated arch. A semicircular catwalk 73 extends from the arch 13 over the semicircular grouping of seats 5 that are located in front of the stage 9. The catwalk 73 is usually accessed from the stairs 71 within the arch 13. The catwalk provides space for theatrical lighting and follow spotlights that are used to illuminate the stage 9. The catwalk 73 is elevated from the stage 9 and provides an ideal location for stage lighting so that the stage lights are at a steep angle with respect to the stage. The steep angle is from about 40° to about 60° with respect to the stage. Such a steep angle for the stage lights prevents flat angles for the stage lights that can be blinding to performers on the stage 9. The stair towers 75 for the stairs 71 also provide an excellent location for side lights (not shown) that can be used to illuminate performers at the front of the stage while reducing shadows. The catwalk can also provide access to the house lights that are used to provide general illumination for the arena 1. The catwalk can also be used to house and support various mechanical equipment, separation curtain 85 and other theatrical equipment that are used in the arena.

The open cavity of the arch 13 allows for the rigging, scenery, theatrical elements and other equipment to be substantially in the middle of the arena but to be concealed and safely out of the public areas of the arena. The stairs 71 provide easy access to the arch 13 to allow the stage hands to effectively handle this equipment and in a manner that enhances safety for the arena. An elevator 74 may be provided for access to the arch 13.

Figure 6:
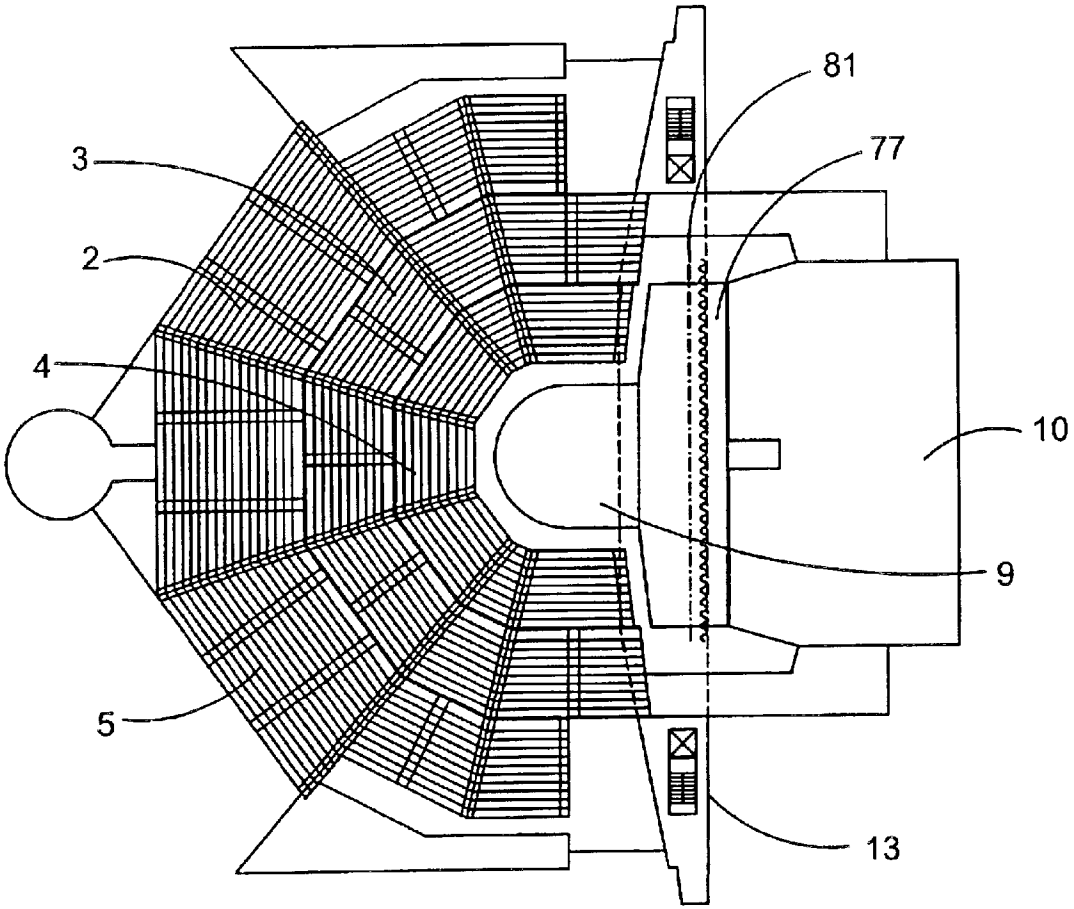
FIG. 6 is a plan view of the interior of the arena in the concert/theatre configuration.
Figure 7:
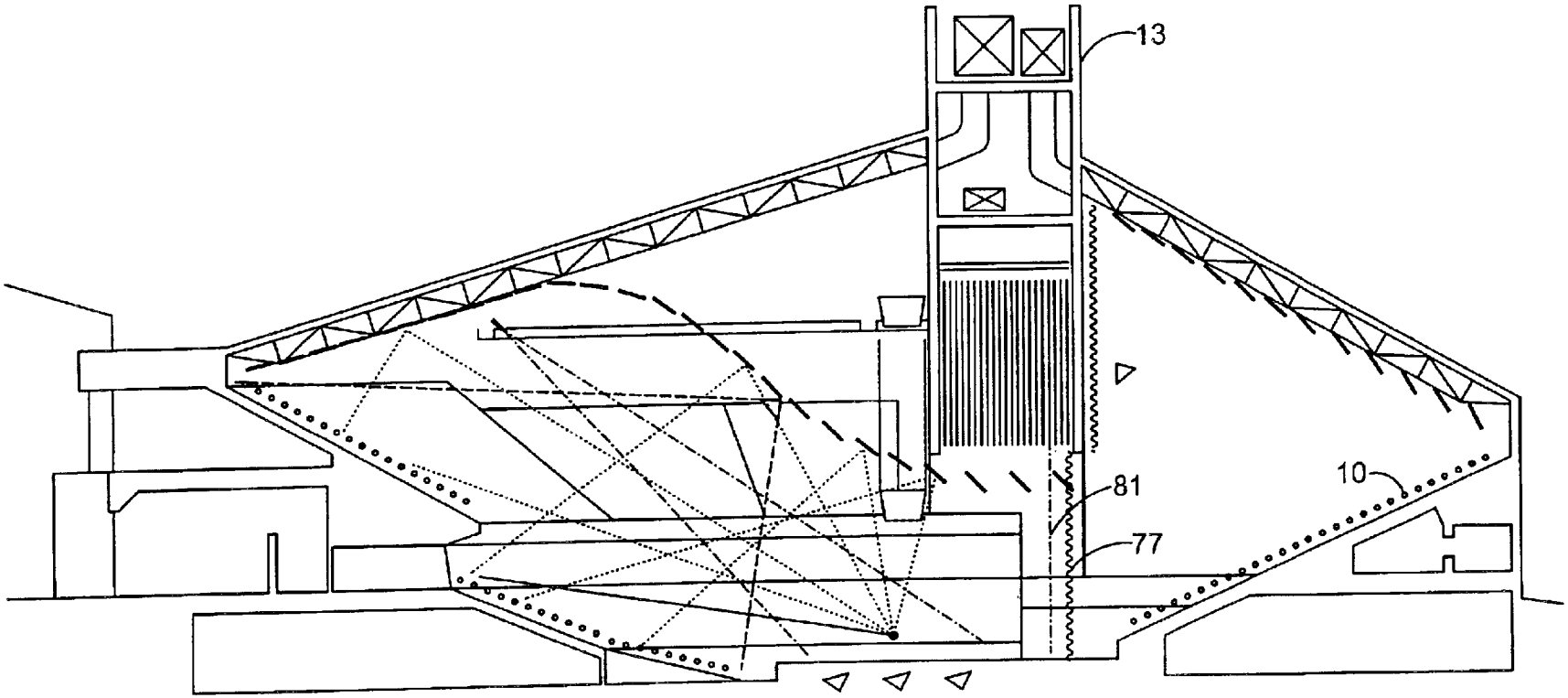
FIG. 7 is a cross-sectional view of the arena configuration of FIG. 6.

In most applications a velour, vertical rise curtain 77 will be positioned in the open cavity 53 of the arch 13 adjacent the wall 49 of the arch. As shown in FIGS. 6 and 7, the velour curtain is usually in three sections with a center section and 2 side sections. The velour curtain is usually to be raised and lowered vertically from the open cavity 53. The velour curtain can be used to help divide the area into various configurations and to control the acoustics in the arena 1. Other curtains, scrims and pieces of scenery can be suspended from the arch 13 as necessary for staging or to control the acoustics in the arena.

Figure 4:
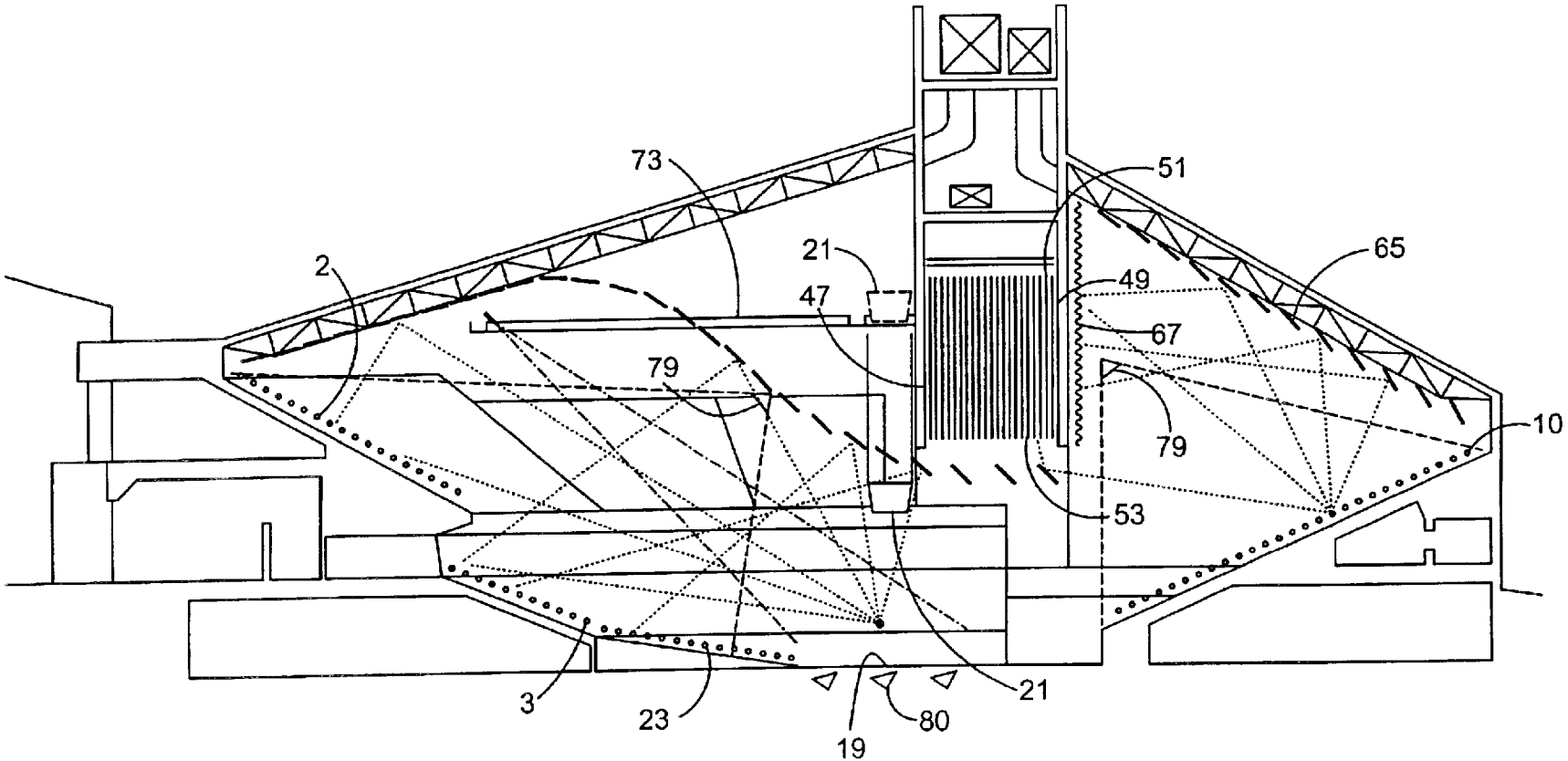
FIG. 4 is a cross-sectional view of the arena configuration of FIG. 3.
Figure 5:
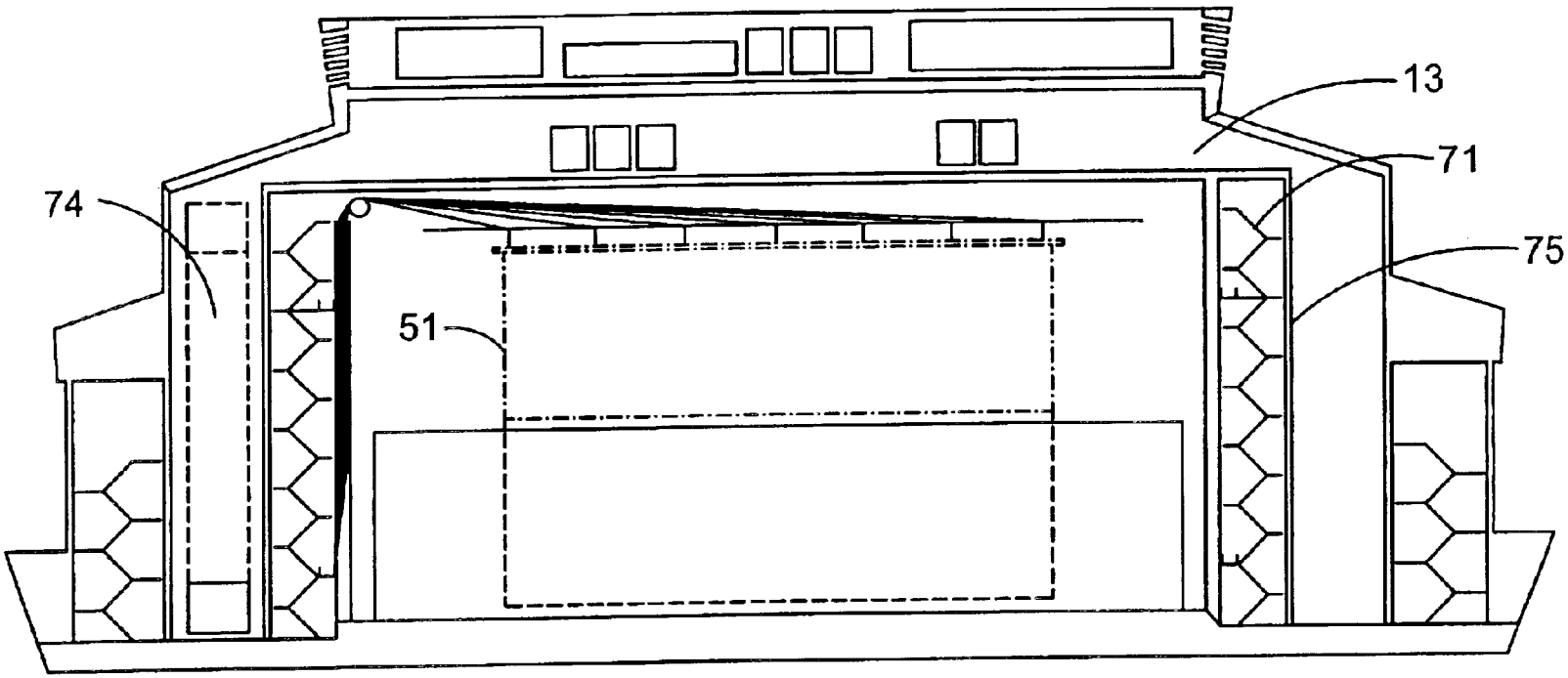
FIG. 5 is a cross-sectional view of the arch of the arena.

As shown in FIG. 2, speakers 79 are also arranged in clusters on wall 47 and wall 49 of the arch 13. The speaker clusters will usually have narrow angles of vertical coverage that help to prevent reinforced sound from spilling beyond the seating area and picking up the natural room acoustics. This positioning for the speakers provides better speech intelligibility for sports or other entertainment uses than in most arenas. The speakers can also be positioned so that they can be serviced from the arch 13 and the catwalk. In addition, as shown in FIGS. 2 and 4, subwoofers 80 can be located under the stage 9 and the sports floor 19 and when so positioned the subwoofers are disposed to use the plane of the floor as a diaphragm. Accordingly, the subwoofers will direct the sound through the floor causing the floor to vibrate with the sound waves produced by the subwoofers. Such a position for the subwoofers will enhance the sound in the arena and the performers on the stage 9 or sports floor 19 will actually feel the sound generated by the subwoofers.

The patrons in the audience are good sound absorbers and assist in controlling the acoustics in the multi-purpose arena 1. The seats are designed to be upholstered so that the seats also assist in controlling the acoustics even when the seats are not occupied. An empty upholstered seat absorbs sound and is substantially the equivalent in sound absorbing characteristics as an occupied seat. In addition, if the seats have a foldable lower portion, the underside of the foldable seat bottom can be upholstered or have a perforated pattern thereon to absorb sound. Also, the backs of the seats can be perforated or upholstered to enhance the sound absorbing properties of the seat. The perforated underside and back of the seat thus provides the desired acoustical properties even when the seat is unoccupied and in the folded position by allowing sound waves to pass through the perforations and be absorbed by the padding and materials in the interior of the seat.

The multi-purpose arena can also be configured in other ways to accommodate theatrical or entertainment applications. As shown in FIGS. 6 and 7, the bank of seats 10 behind the stage 9 have been closed off by a curtain, panels or other screening device. The curtain can be lowered from the elevated arch 13 that extends across the width of the arena 1. As previously described, curtains can be used to alter the configuration and seating capacity of the arena 1. As shown in FIGS. 6 and 7, the bank of seats 10 behind the stage 9 are closed off by the velour curtain 77 that extends from the arch 13. The velour curtain 77 can be adjusted, i.e., various sections raised or lowered to tune the acoustics in the arena. The area behind the back of the stage 9 where the bank of seating 10 is located is essentially a large sound absorbing chamber. If sections of the velour curtain 77 are raised, this will bring the sound absorbing characteristics of this portion of the arena into use as part of the acoustical package of the arena 1. Use of the sound absorbing qualities of this portion of the arena 1 will produce shorter sound reverberation time and create conditions more conducive to stage shows. The velour curtain 77 can be manipulated until the desired sound characteristics are achieved. If portions of the velour curtain 77 are raised, an acoustically transparent scrim 81 can be positioned over the area no longer covered by the velour curtain to obtain the visual isolation desired. The scrim 81 can also be used to create various lighting effects as is known in the theatre industry.

Figure 8:
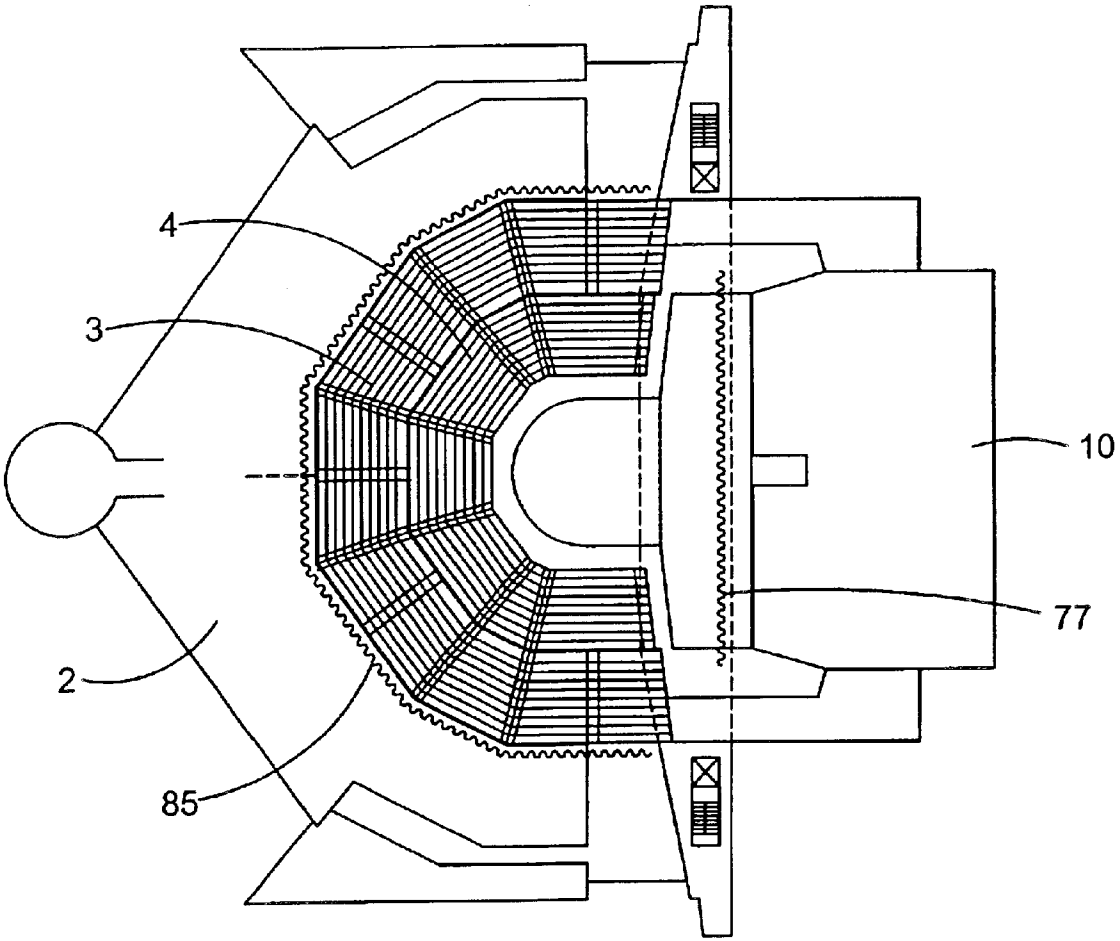
FIG. 8 is a plan view of the interior of the arena in the intimate seating arrangement.
Figure 9:
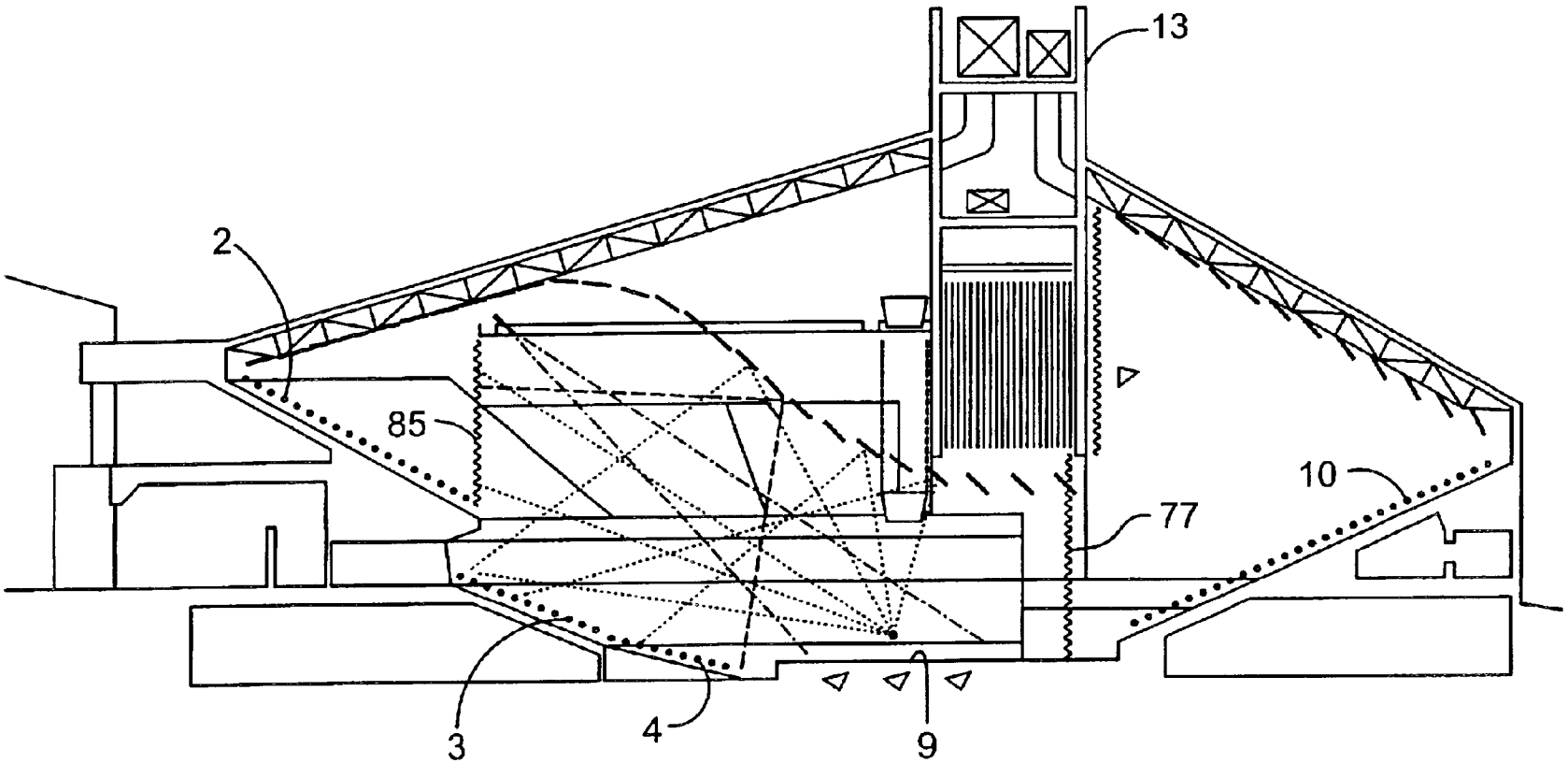
FIG. 9 is a cross-sectional view of the arena configuration of FIG. 8.

As shown in FIGS. 8 and 9, the arena 1 can be made even more intimate by only using the mid-level 3 and lower level 4 seats that are generally semicircular or concentric in orientation around the stage 9. In the configuration shown in FIG. 8, the upper seating level 2 in front of stage 9 is not in use and is separated from the stage 9 by a separation curtain 85 or other similar screening device. The separation curtain 85 that is used to separate the upper seating level 2 from the rest of the seats in the front of the stage 9 can also be a velour curtain. The separation curtain 85, when lowered, will shorten the sound reverberation time in the arena to improve the sound characteristics when the arena is used for a verbal presentation such as a speech or a small music ensemble such as a string trio. The arena 1 can be tuned acoustically by raising and lowering the separation curtain 85. If the separation curtain 85 is raised, a longer sound reverberation time is created. If the separation curtain 85 is raised a lightweight acoustically transparent curtain (not shown) can be lowered to visually remove the upper seating level 2 from the arena. This results in an arena that is visually smaller while still retaining an acoustically large volume. By varying the position of the separation curtain 85 at the back of the seating area and the curtain 77 behind the stage, the acoustical properties of this configuration of the arena 1 can be varied or adjusted.

Figure 10:
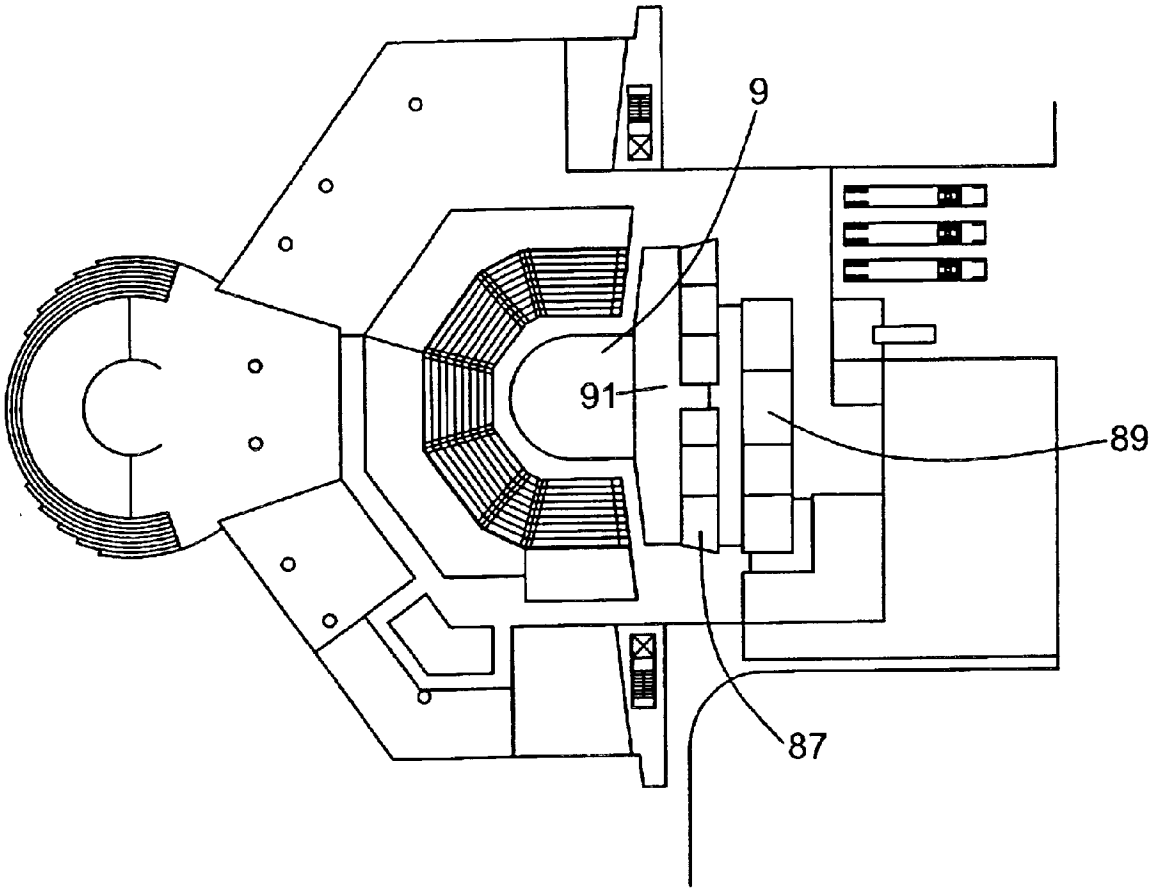
FIG. 10 is a plan view of the interior of the arena showing the dressing rooms and backstage areas.

A plurality of dressing rooms 87 and possibly green rooms 89 are located under the bank of seats 10 behind the stage 9 as shown in FIGS. 1, 2 and 10. The dressing rooms 87 and green rooms 89 are accessible to the stage 9 through passageway 91 that extends through the bank of seats 10 to the area adjacent the back of the stage 9. The passageway 91 provides a convenient and secure means to give performers access to the stage 9 in a large arena that is similar to the access provided in small theatres.

As shown in FIGS. 1 through 9, the arena can be used for many different events and can be configured to accommodate a crowd that is suitable for a particular planned event. Accordingly, the arena can be used for relatively small and intimate events, medium sized events and large events that require the full seating capacity of the arena. As an example, a small event will utilize from about 10 to about 35 percent of the seating capacity of the arena, a medium event will utilize from about 30 to about 75 percent of the seating capacity and a large event will utilize from about 70 to about 100 percent of the seating capacity.

Figure 3:
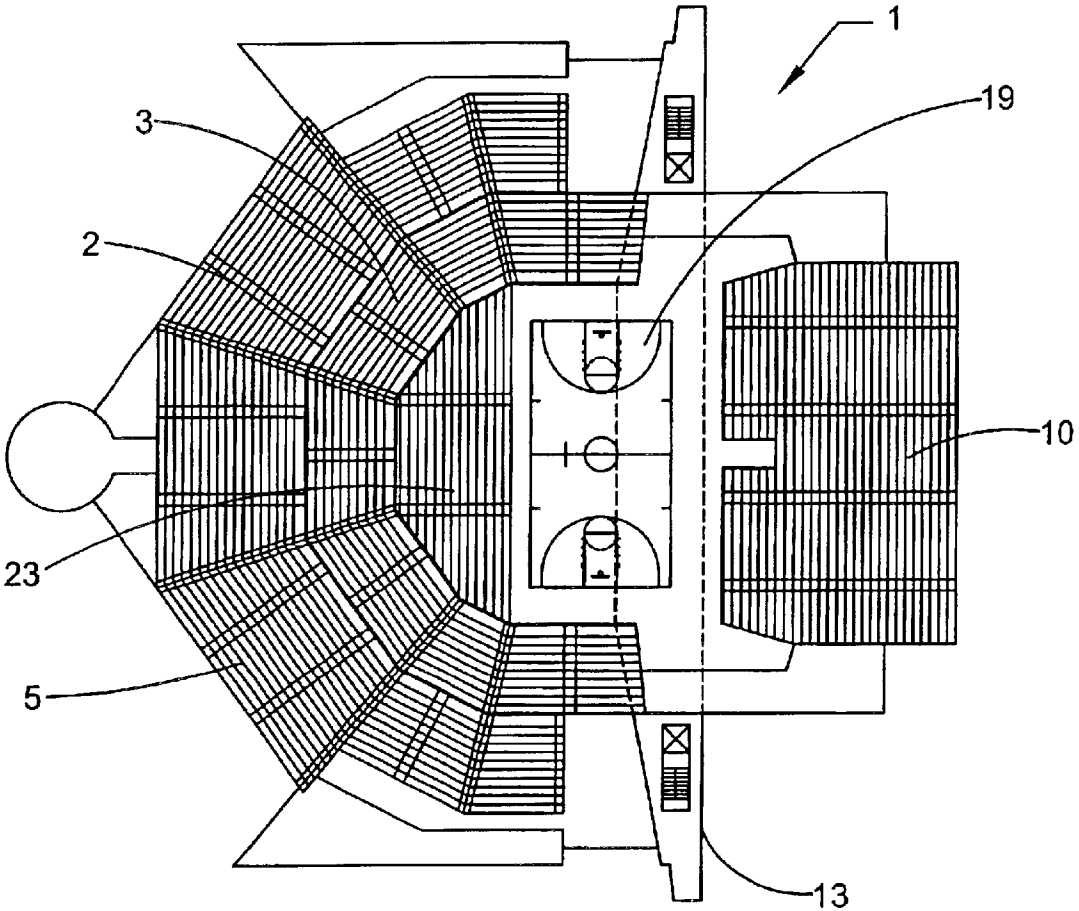
FIG. 3 is a plan view of the interior of the arena with the sports floor in place.

As shown in FIGS. 3 and 4, the arena can-also be configured to be used as a basketball or sports facility. When used as a basketball facility, the lower level seating 4 is folded back under the mid-level seating 3 and the floor area at this section is raised to stage level. The basketball court or sports floor 19 can be positioned in the portion of the arena formerly occupied by the stage 9 and the lower level seats 4. The stage 9 can also have a surface that is a sport-floor material so that the stage forms at least a part of the sports floor. The sports floor 19 can be a permanent part of the arena or a portable floor surface that is moved into position when needed. The sports floor will essentially be at the floor level of the stage 9. While mid-level seats 3 extend in a semi-circular fashion around one side and the ends of the basketball court 19, the upper level seats 2' are generally arranged elliptically to facilitate viewing of court 19 as shown in FIG. 13. A bank of court side sport seats 23 are positioned along the side of the sports floor or basketball court 19 that faces the mid-level seats 3 to fill in a portion of the area vacated by the lower level seating 4. Portable or trailored sports seats 23 fill up the area between the side of the basketball court to the midlevel seating 3 in the arena 1. The bank of seats 10 are on the opposite side of the sports floor or basketball court from the court side seats 23. The arena 1 is configured so that it is not symmetrical around the basketball court 19. The bank of seats 10 on one side of the court is considerably smaller than the semi-circular bank of seats 5 on the opposite side of the sports floor or basketball court 19. It is anticipated that the seats 2, 3 and 4 in the semi-circular or elliptical portion of the arena would be the most desirable seats and would be reserved for the fans supporting the home team. The bank of seats 10 on the opposite side of the basketball court could be used for the fans of visiting teams. The elevated arch 13 extends over the sports floor or basketball court 19 and is elevated sufficiently from the basketball court that a scoreboard 21 could be suspended adjacent to the elevated arch. When not in use, it would be possible to advance or move the scoreboard away from the floor of the arena and adjacent to the elevated arch so that the scoreboard would not be particularly visible when not needed for athletic events.

FIG. 2 shows additional details of the interior of the arena to make it particularly suitable for a wide variety of uses. As shown in FIG. 2, the upper level seating 2 is positioned on an elevated, inclined fixed structure 27 that is spaced above the stage 9. The mid-level seating 3 is positioned on a lower elevated, inclined fixed structure 29 that is positioned above the stage 9. The lower level retractable seating 4 extends from the floor 33 of the arena 1 to the lower inclined structure 29. The lower level seating 4 folds and can be retracted and stored under the lower inclined structure 29 when not in use. Positioned between the upper inclined structure 27 and the lower inclined structure 29 can be a series of private suites 37 that can be used for major donors or sponsors for the arena. The private suites will normally have a glass wall 39 to separate the private suites from the open seating in the stands of the arena. The glass wall 39 is usually positioned at an angle from vertical. The angled position on the glass wall reduces unwanted sound reflection that could cause echoes or other undesirable acoustical conditions in the arena. The glass is tilted to reflect sound to the absorbent seating area to avoid unwanted sound reflection. The stage side lower edge of the upper inclined structure 27 that is adjacent the private suites 37 can have an upwardly angled ceiling surface 43 to enhance the viewing from the private suites 37 and to allow direct sound to seats below ceiling 43.

The stage 9 and floor 33 can be positioned on a hydraulic or mechanical lift mechanisms (not shown) that can be used to move the stage relative to the floor 33 of the arena 1. The stage can be moved so that it is in a proper position to allow the audience in the seating areas to view whatever is taking place on the stage. The stage 9 is configured so that the center of the stage is essentially the same location and elevation as the center of the sports floor or basketball court 19 that can be positioned in the arena 1. The center of the stage is also located so that it is on one side of the elevated arch 13 that is positioned above the stage 9.

The bank of seats 10 behind the stage 9 are positioned on an elevated and inclined fixed structure 57. The bank of seats 10 are positioned so that they are behind the stage 9 and behind the wall 49 of the elevated arch 13. As shown in FIGS. 12 and 13, a portion of the seats 10' behind the performing area of the arena can be positioned at an angle to improve viewing angles for the patrons.

Figure 14:
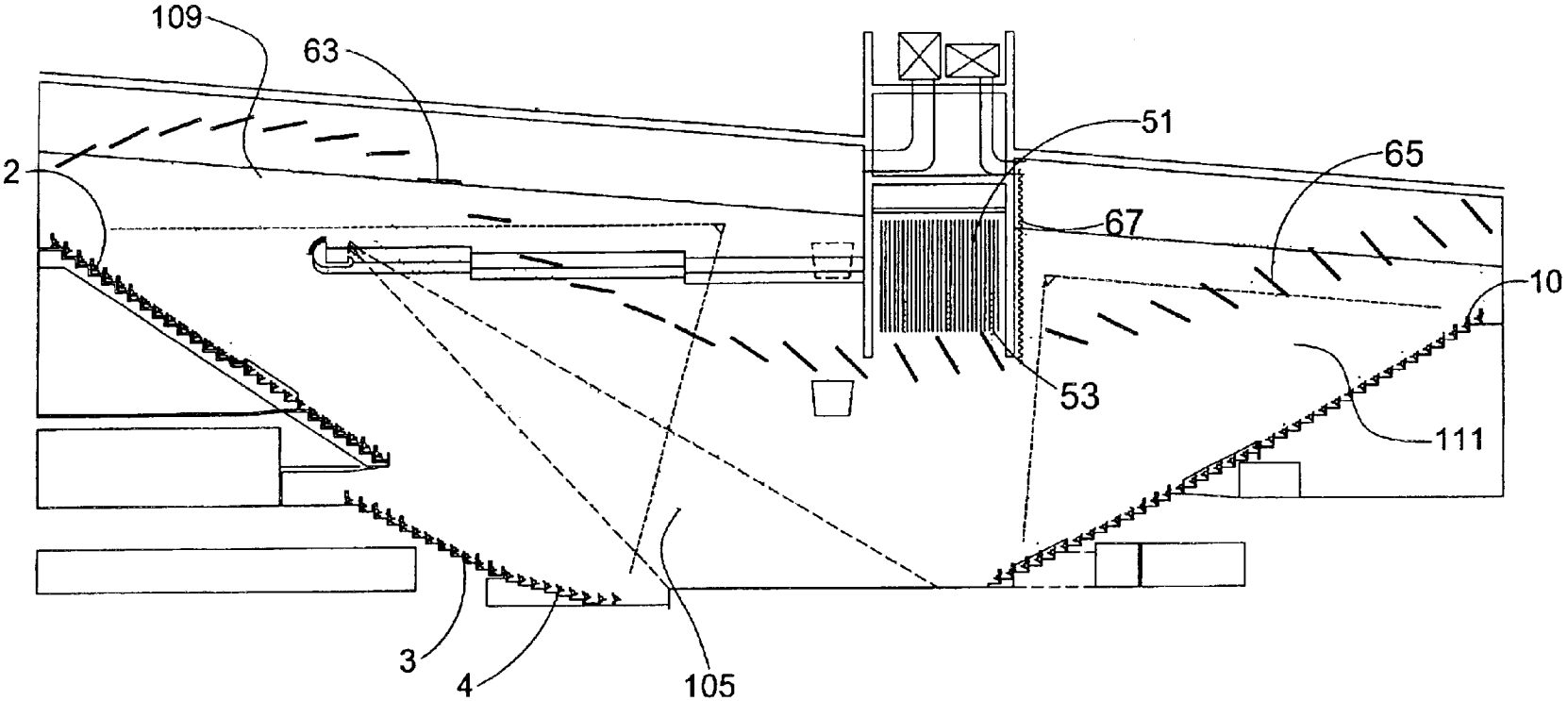
FIG. 14 is a cross-sectional view of the multi-purpose arena.

The roof of the arena 1 is positioned substantially above all of the seating areas in the arena. The roof over the seating areas 2, 3 and 4 in front of the stage 9 extends from the elevated arch 13 to the outer wall 61 of the arena 1. To enhance the acoustical properties of the arena, a series of reflective panels 63 are positioned above the stage 9 and over seating areas 2, 3 and 4 so that sound from the stage or the basketball court bounces off of the reflective panels and to the patrons in these seats. At the same time, sound from the patrons such as applause or cheering is directed up to the reflective panels 63 and directed down to the performers or athletes on the stage or basketball court. FIG. 14 shows how the sound waves 105 from the stage or court area of the arena are reflected by the panels 63 to the patrons in the seating areas 2, 3 and 4 and how sound waves 109 from the patrons in these seating areas are reflected by the panels 63 to the stage or court area. As previously described, the seats in the arena are upholstered to help absorb undesirable reflected sound when unoccupied. In addition, having a less varied acoustical environment is beneficial to musicians and performers because there is less acoustical change between rehearsal conditions and presentation conditions with patrons in the seats.

The roof of the arena over the bank of seats 10 behind the stage 9 extends from the elevated arch 13 to the outer wall 61 of the arena. A plurality of absorbent and reflective thin plywood panels 65 are positioned adjacent to the roof over the bank of seats 10 behind the stage 9. The plywood panels absorb low frequency sound and reflect medium and high frequency sound. The panels remove the low frequency sound generated by the audience in the bank of seats 10 by deflecting or moving to absorb these low frequency sound waves. At the same time, the hard surface of the panels 65 reflect the medium and high frequency sounds to the wall 49 on the elevated arch 13. Sound absorbing panels 67 are positioned on the wall 49 of the elevated arch 13 to absorb the sound reflected by the plywood panels 65. In this manner, the sound produced by the patrons in the bank of seats 10 behind the stage 9 is either partially absorbed by the plywood panels 65 if the sound is a low frequency sound and/or reflected by the plywood panels 65 to the sound absorbing panels 67 on the wall 49 of the elevated arch 13 if the sound is a higher frequency. In this manner, the sound produced by the patrons in the bank of seats 10 behind the stage 9 is minimized. The reflective panels 63 over the stage area are also angled so that sound from the bank of seats 10 behind the stage 9 that is directed towards the stage 9 strikes these panels. The panels deflect this sound up into the rigging in the open cavity 53 of the elevated arch 13 further reducing the impact of the sound generated by the patrons in the bank of seats 10. FIG. 14 shows how sound waves 111 from the patrons in the bank of seats 10 are reflected or absorbed by the panels 65 and reduce the impact of the sound from this seating area. In short, sound from the home team spectators is collected, directed and passively amplified and sound from the visiting team spectators is passively minimized.

Figure 11:
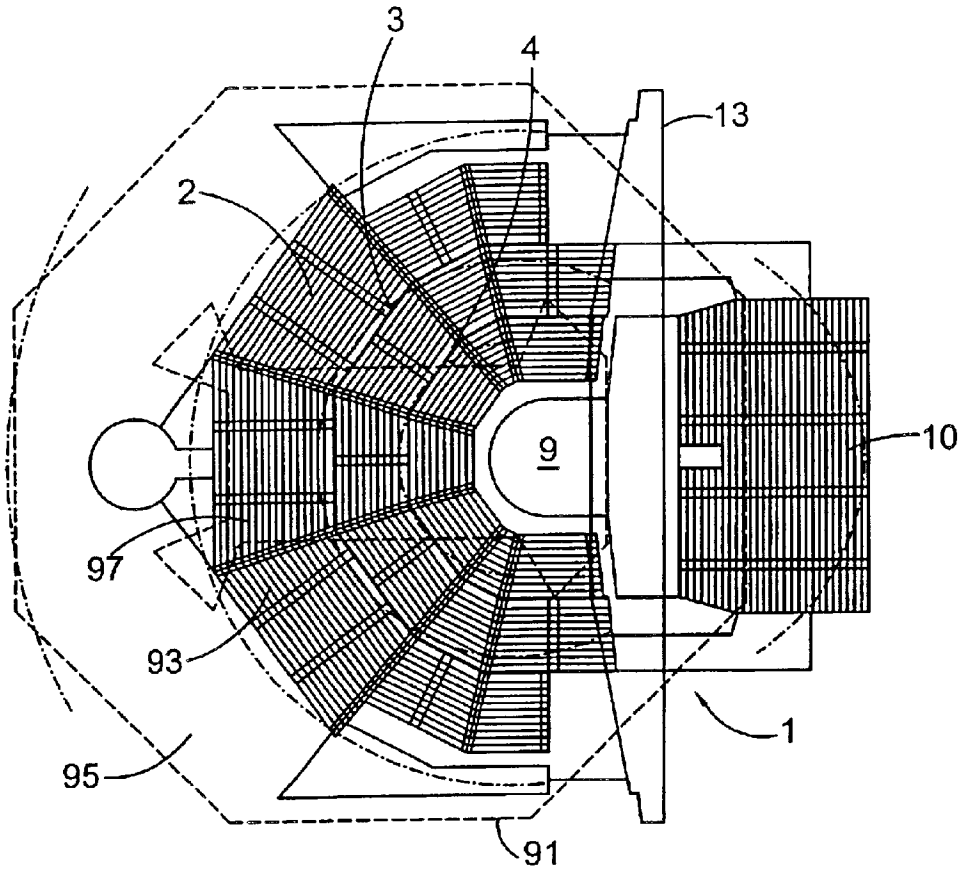
FIG. 11 is a plan view of the interior of the multi-purpose arena of the present invention in comparison with the interior of a traditional sports oriented area shown in phantom.

FIG. 11 compares the seating arrangement, lines of sight and distances from the performing area for the multi-purpose arena 1 of the present invention and a traditional sports oriented arena 91. Both arenas have substantially the same seating capacity and the sports arena 91 is shown in broken or dashed lines positioned behind the multi-purpose arena 1. The stage area 9 for both facilities is positioned at a common location. The sports arena has a lower seating area 93 and an upper seating area 95. The seats in the upper and lower seating areas in the sports arena 91 are all oriented to view the activity on the floor 97 of the sports arena. When a performance is taking place on the stage 9, a large portion of the seats in the sports arena are angled in the wrong direction and do not provide comfortable viewing positions and sight lines to the stage 9. In addition, from about 25% to about 50% of the seats in the sports arena 91 are located at a considerable distance from the stage 9 so that the patrons in these seats have poor visual contact with the performers on the stage 9. In the multi-purpose arena 1 of the present invention, the seats are all angled towards the stage 9 and provide good lines of sight to the stage. Because of the configuration of the seats around the stage, the seats are much closer to the stage 9 and have good visual contact with the performers on the stage.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

We claim:

1. A multi-purpose arena comprising:

a performance area;

a first seating area that is disposed to receive sound directly from the performance area and to transfer sound to the performance area; and sound reflecting panels positioned over said performance area to reflect sound to said first seating area;

sound reflecting panels positioned over the first seating area to direct sound from the performance area to the first seating area, said reflecting panels further directing sound from said first seating area to said performance area, said reflective panels are moveable and can be varied in position to tune the acoustics in the first seating area;

a second seating area that is acoustically suppressed from transferring sound to the performance area;

a plurality of seats positioned in the first and second seating areas and said seats are disposed on tiers that define an angle with respect to said performance area, said seats in said first and second areas are at an increased elevation as said seats are spaced further from said performance area yet provide good viewing of said performance area; and an elevated arch positioned over said performance area and between said first and second seating areas, said arch having a first wall that faces said first seating area and a second wall that faces said second seating area, said first and second walls of said arch being spaced apart and define a cavity.

2. The arena of claim 1 wherein rigging, lighting, curtains and other theatrical equipment are adapted to be positioned in said cavity in said arch for use in said performance area.

3. The arena of claim 2 wherein the second wall of said elevated arch that faces said second seating area is covered with sound absorbing material.

4. The arena of claim 3 wherein a plurality of panels are positioned over said second seating area, said panels being designed to absorb a substantial portion at the low frequency sound and to reflect sound that is not absorbed.

5. The arena of claim 4 wherein said panels over said second seating are positioned to reflect said sound not absorbed by said panels to said absorbent material positioned on said second wall of said elevated arch.

6. The arena of claim 5 wherein a sound blocking curtain is adapted to be lowered from said cavity in said elevated arch to close off the second seating area from said performance area to modify the seating configuration of said arena.

7. The arena of claim 6 wherein said sound blocking curtain is in more than one section and section is adapted to be lowered to vary the acoustical characteristics in said performance area.

8. The arena of claim 7 wherein an acoustically transparent scrim is adapted to be lowered from said cavity of said elevated arch to cover any areas not covered by said sound blocking curtain, said acoustically transparent scrim to further vary the acoustical characteristics in said performance area.

9. The arena of claim 8 wherein said first seating area has more than one discrete seating area.

10. The arena of claim 9 wherein a first portion of the seats in the first seating area are arranged in a generally semi-circular configuration and a second portion of the seats in the first seating area are arranged in a generally elliptical configuration to provide improved lines of sight.

11. A multi-purpose arena comprising:

a performance area;

a first seating area that is disposed to receive sound directly from the performance area and to transfer sound to the performance area; and a second seating area that is acoustically suppressed from transferring sound to the performance area; and an elevated arch positioned over said performing area and between said first and second seating areas, said arch having a first wall that faces said first seating area and a second wall that faces said second seating area, said first and second wails or said arch being spaced apart and defining a cavity.

12. The arena of claim 11 wherein sound reflecting panels are positioned over said performance area to reflect sound to said first seating area.

13. The arena of claim 12 wherein sound reflecting panels are positioned over the first seating area to direct sound from the performance area to the first seating area, said reflecting panels further directing sound from said first seating area to said performance area.

14. The arena of claim 13 wherein said reflective panels are moveable and are adapted to be varied in position to tune the acoustics in the first seating area.

15. The arena of claim 14 wherein the first and second seating area includes a plurality of seats and said seats are disposed on tiers that define an angle with respect to said performance area.

16. The arena of claim 15 wherein said seats in said first and second areas are at an increased elevation as said seats are spaced further from said performance area yet provide good viewing of said performance area and further comprising:

an elevated arch positioned over said performance area and between said first and second seating areas, said arch having a first wall that faces said first seating area and a second wail that faces said second seating area, said first and second walls of said arch being spaced apart and define a cavity.

17. The arena of claim 11 wherein rigging, lighting, curtains and other theatrical equipment are adapted to be positioned in said cavity in said arch for use in said performance area.

18. The arena of claim 11 wherein rigging, lighting, curtains and other theatrical equipment are adapted to be positioned in said cavity in said arch for use in said performance area.

19. The arena of claim 18 wherein a plurality of panels are positioned over said second seating area, said panels being designed to absorb a substantial portion of the low frequency sound and to reflect sound that is not absorbed.

20. The arena of claim 19 wherein said panels over said second seating are positioned to reflect said sound not absorbed by said panels to said absorbent material positioned on said second wall of said elevated arch.

21. The claim arena of claim 20 wherein a sound blocking curtain is adapted to be lowered from said cavity in said elevated arch to close off the second seating area from said performance area to modify the seating configuration of said arena.

22. The arena of claim 21 wherein said sound blocking curtain is in more than one section and each section is adapted to be lowered to vary the acoustical characteristics in said performance area.

23. The arena of claim 22 wherein an acoustically transparent scrim is adapted to be lowered from said cavity of said elevated arch to cover any areas not covered by said sound blocking curtain, said acoustically transparent scrim serving to further vary the acoustical characteristics in said performance area.

24. The arena of claim 23 wherein said first seating area has more than one discrete seating area.

* * * * *

UNITED STATES PATENT AND TRADEMARK OFFICE

CERTIFICATE OF CORRECTION

PATENT NO. : 6,915,610 B2
APPLICATION NO. : 10/222338
DATED : July 12, 2005
INVENTOR(S) : Charles H. Stark, III et al.

It is certified that error appears in the above-identified patent and that said Letters Patent is hereby corrected as shown below:

In column 10, line 12, please delete “wail” and insert --wall--

Signed and Sealed this

Third Day of October, 2006

JON W. DUDAS
*Director of the United States Patent and Trademark Office*

UNITED STATES PATENT AND TRADEMARK OFFICE

CERTIFICATE OF CORRECTION

PATENT NO. : 6,915,610 B2
APPLICATION NO. : 10/222338
DATED : July 12, 2005
INVENTOR(S) : Charles H. Stark, III et al.

It is certified that error appears in the above-identified patent and that said Letters Patent is hereby corrected as shown below:

In column 10, line 19, Claim 18, please delete "The arena of claim 11 wherein rigging, lighting, curtains and other theatrical equipment are adapted to be positioned in said cavity in said arch for use in said performance area" and insert --The arena of claim 17 wherein the second wall of said elevated arch that faces said second seating area is covered with sound absorbing material--

Signed and Sealed this

Twelfth Day of December, 2006

JON W. DUDAS
*Director of the United States Patent and Trademark Office*